United States Patent [19]

Bussert

[11] Patent Number: 4,836,265

[45] Date of Patent: Jun. 6, 1989

[54] TEMPORARY WINDOW SHADES

[76] Inventor: Althea J. Bussert, 610 W. Peralta Cr., Mesa, Ariz. 85202

[21] Appl. No.: 37,686

[22] Filed: Apr. 13, 1987

[51] Int. Cl.[4] ..... A47H 23/00

[52] U.S. Cl. ..... 160/354

[58] Field of Search ..... 160/354, 368 R, 327, 160/328, 243, 242, DIG. 1, 387, 351, 135

[56] References Cited

U.S. PATENT DOCUMENTS

| | | | |
|---|---|---|---|
| 2,246,663 | 6/1941 | Bradshaw | 160/354 |
| 3,913,655 | 10/1975 | Ogino | 160/354 X |
| 3,996,083 | 12/1976 | Morgan et al. | 160/387 X |
| 4,221,256 | 9/1980 | Karaki | 160/368 R |
| 4,249,589 | 2/1981 | Loeb | 160/354 X |
| 4,560,245 | 12/1985 | Sarver | 160/354 X |

*Primary Examiner*—Blair M. Johnson

*Attorney, Agent, or Firm*—Cahill, Sutton & Thomas

[57] ABSTRACT

A temporary window shade is provided for use in buildings which have not yet had permanent draperies or blinds installed. The shade is made from a sheet of disposable material, the top, bottom and side edges of which have been folded to form hems. Stiffener strips are inserted in the top and bottom hems to provide rigidity. The top hem is attachable to the wall above a window. The bottom stiffener strip includes hook means which are receivable in slots formed along the side edges of the shade to hold the bottom edge of the shade in a raised configuration. Each hook means is preferably a double hook, having an upturned portion providing through one face of the shade and a downturned portion projecting through the opposite face of the shade to allow the shade to be foldced twice.

9 Claims, 1 Drawing Sheet

TEMPORARY WINDOW SHADES

BACKGROUND OF THE INVENTION

1. Field of the Invention

This invention relates in general to window coverings and, more particularly, to temporary window shades.

2. Description of the Prior Art

New home owners and renters very often find that they must wait a long period of time before they are able to install new shades or draperies in their windows. This is especially true in the case of custom-made draperies, since the process of measuring, ordering and stitching the drapery materials is quite lengthy, but not even ready-made draperies can be purchased immediately, since they are somewhat expensive and since the buyer needs time to shop around before finally selecting permanent drapes. Thus, in order to protect their privacy as well as to block out bright sunlight, new homeowners frequently resort to temporary measures such as hanging sheets or pasting up newspapers or the like over their windows. Such measures are usually unsatisfactory, however, as the sheets or newspapers are a nuisance to put up and tend to detract from the appearance of the house. In addition, there is no convenient means for raising and lowering these types of window coverings. Thus, the homeowner can not vary the amount of light shining through the windows as is possible with conventional curtains or blinds.

The closest known prior art attempt to solve the above problems is described in U.S. Pat. No. 3,913,655 to Ogino. The Ogino patent discloses a temporary paper curtain having a first strip of stiffener material attached to its top edge and a second strip of stiffener material attached to its bottom edge. The first strip serves as an attachment strip for attaching the curtain to a wall, and the second strip serves as a stiffening and weighting device to ensure that the curtain hangs correctly. in one embodiment of the invention, bores are provided through each of the stiffener strips, and a plurality of vertically spaced apart holes are provided along one side of the paper sheet, with a pull cord passing through the bores and the aligned holes to allow the curtain to be raised and lowered. However, this means for raising and lowering the curtain is not entirely satisfactory, since the process of boring holes in the stiffener strips and threading the pull cord through the sheet adds to the cost and complexity of manufacturing the product.

Therefore, a need exists for a new and improved temporary window shade which overcomes some of the shortcomings of the prior art.

SUMMARY OF THE INVENTION

In accordance with the present invention, a new and improved temporary window shade includes means for securing the lower edge of the shade in a plurality of upwardly folded raised positions, allowing the homeowner to selectively vary the effective length of the shade.

The shade includes a sheet of rugged, relatively inexpensive material such as nylon fabric, polyester, or reinforced paper. The upper and lower edges of the sheet are preferably folded to form hems, and stiffening strips or rods are inserted in the hems to provide rigidity. The hem along the top edge is provided with fastening means such as double-sided adhesive tape, fabric hook and loop type fasteners, or holes or receiving nails or hooks or the like, in order to secure the shade to a wall above a window.

The means for selectively varying the length of the shade comprises a pair of hook means, with each hook means extending normally from proximate opposite ends of the bottom stiffening strip. A plurality of slots is formed in longitudinally spaced increments proximate the vertical edges of the sheet for receiving the hook means. In order to raise the shade to a desired height, the homeowner merely folds the shade upwardly and fixes the bottom edge of the shade in the folded position by passing the hooks through a selected transversely aligned pair of slots in the sheet.

Accordingly, it is an object of this invention to provide a new and improved shade structure with means for temporarily mounting the shade on the wall above a window.

Another object of the invention is to provide a temporary window shade which can be simply and inexpensively constructed from disposable materials.

Still another object of the invention is to provide a temporary window shade with means for securing the bottom edge of the shade in a variety of folded positions in order to selectively vary the effective length of the shade.

The foregoing and other objects of the present invention, as well as the invention itself, may be more fully understood from the following description when read in conjunction with the accompanying drawings.

DETAILED DESCRIPTION OF THE INVENTION

Figure 1:
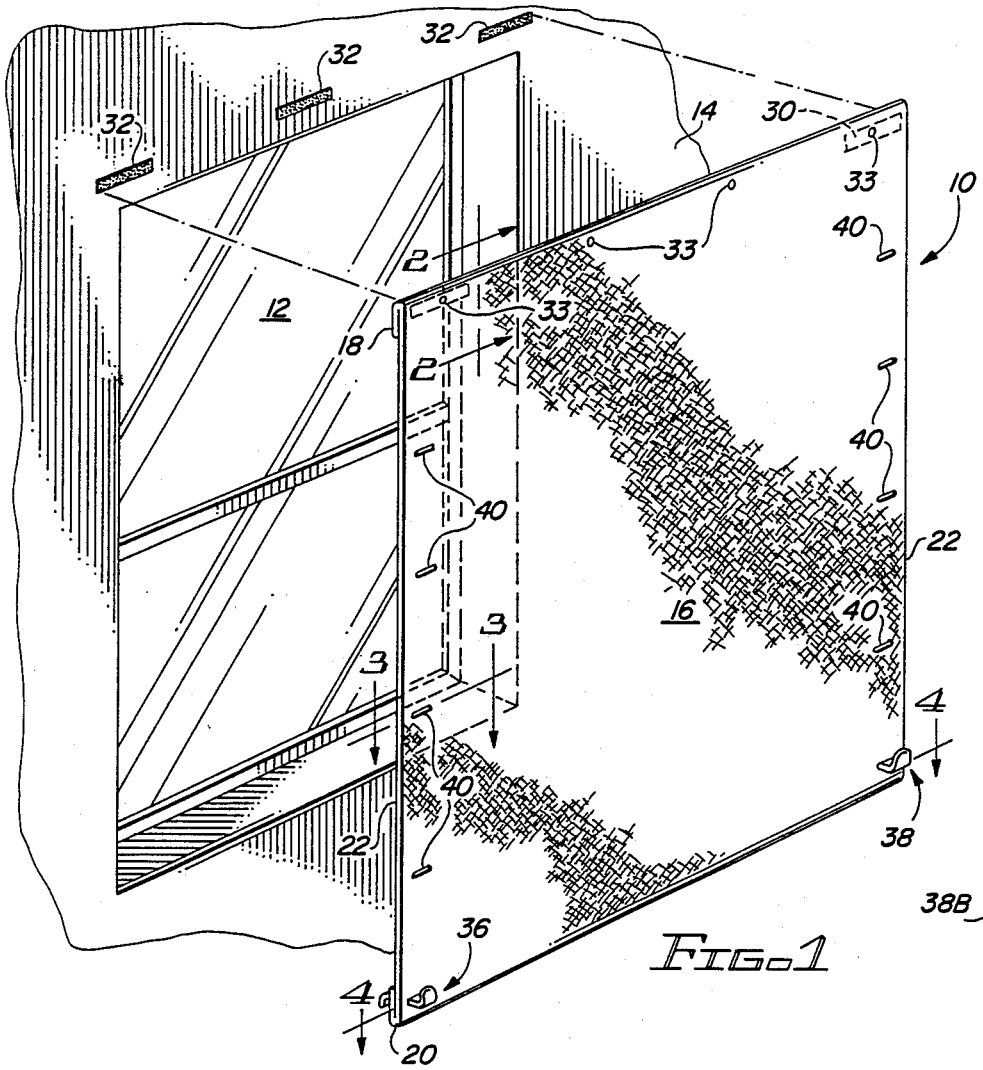
FIG. 1 is a perspective view showing the temporary window shade of the present invention in exploded relation to a conventional window.

Referring more particularly to the drawings, FIG. 1 shows the temporary window shade of the present invention, indicated in its entirety by the numeral 10. The window shade 10 is shown in exploded relationship to a conventional window 12 in the wall 14 of a home, office or other building which has not yet had permanent decorator drapes or blinds installed.

The shade 10 includes a sheet 16 of rugged, flexible and relatively inexpensive material such as nylon fabric, polyester, or reinforced paper. The material chosen should be disposable and strong enough to withstand being repeatedly folded and unfolded at least several times and preferably an unlimited number of times. The material may be provided in a variety of solid colors, or may be provided with any suitable design or pattern. In addition, because windows are available in an enormous variety of sizes, it is preferred that the material be easy to cut to the desired dimensions using standard heavy-duty scissors or cutting equipment.

Figure 2:
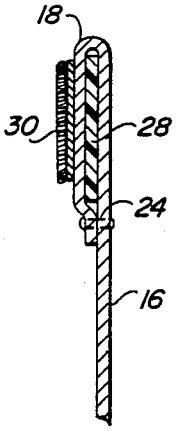
FIG. 2 is an enlarged fragmentary sectional view taken through line 2—2 of FIG. 1.
Figure 3:
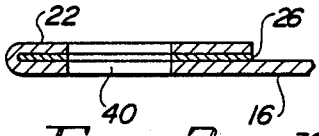
FIG. 3 is an enlarged fragmentary sectional view taken through line 3—3 of FIG. 1.
Figure 5:
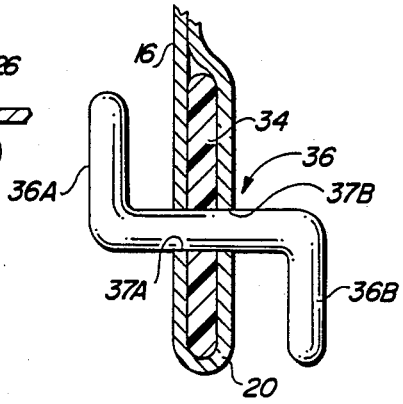
FIG. 5 is an enlarged fragmentary sectional view taken through line 5—5 of FIG. 4.

In order to prevent the edges of the sheet 16 from fraying, the top edge, bottom edge, and side edges of the sheet are folded rearwardly towards the window to form a top hem 18, bottom hem 20 and side hem 22 (only one shown) respectively. Each of the hems may be secured to the back surface of the sheet 16 by any suitable means, such as by stitching 24 as shown in FIG. 2, or by a double-sided adhesive tape 26 such as carpet tape, as shown in FIG. 3.

In order to provide a rigid attachment surface for mounting the shade 10 to the wall 14 above the window 12, a rod, bar or strip 28 of stiffener material such as wood or plastic is inserted into the top hem 18 of the shade to extend along the entire length of the top edge of the sheet 16. The back side of the hem 18 which faces the wall 14 is provided with fastening means such as a strip or strips of double-sided adhesive tape (not shown) or loop and hook type fasteners 30 such as the type commonly sold under the trade name "Velcro", which engage with mating fasteners 32 provided on the wall 14, for demountably securing the shade 10 over the window 12. In addition, a plurality of through-holes 33 is provided along the top edge of the shade, for receiving fasteners such as nails or tacks if the homeowner prefers to mount the shade 10 to the wall in this way. However, means such as adhesive or loop and hook-type strips, which if carefully applied, do not permanently mar the surface of the wall, are generally preferable to destructive fasteners such as nails.

In order to provide weight and to ensure that the shade 10 hangs properly, a stiffener bar or strip 34 is also provided inside the bottom hem 20 of the shade. Like the top stiffener strip 28, the bottom strip 32 may be formed of either wood or plastic. In addition, the bottom bar or strip 34 is provided with a pair of hook means 36, 38 with each hook means being provided proximate each of the opposite ends of the strip 34. The hook means 36, 38 may be formed of metal or plastic and may, in the case of plastic hook means 36, 38 and a plastic strip 34, either be formed integrally with the strip or formed separately and fusion-welded, glued, or otherwise affixed thereto or, in the case of a wooden strip 34 and metal hook means 36, 38, the hooks may be merely screwed or press-fit in appropriate bores provided in the strip.

Each hook means 36, 38 may be formed as either a single upturned hook projecting forwardly from the front face of the shade, a single downturned hook projecting rearwardly from the rear face of the shade, or as in the illustrated embodiment, a double hook. Double hood means 36 comprises an upturned portion 36A which projects forwardly through an opening 37A formed in front face of the sheet 16 and a downturned portion 36B which projects rearwardly through an opening 37B formed in the bottom hem 20 of the sheet 16. Similarly, double hook means 38 comprises an upturned portion 38A which projects forwardly through an opening 39A formed in the front face of the sheet 16 and a downturned portion 38B which projects rearwardly through an opening 39B in the bottom hem 20 of the sheet 16. The downturned and upturned portions of each hook means 36, 38 may be fused together to form a unitary body as shown, or each double hook means may consist of two separate, oppositely directed hooks secured to opposite sides of the bottom stiffener strip 34.

A plurality of vertically spaced apart slits 40 are cut through the side hems 22 and front surface of the window shade 16 in spaced increments intermediate the top and bottom edges and proximate each of the side edges. The slits 40 may be formed in any convenient manner. However, it is recommended that if the sheet 16 is made of a synthetic polymer material such as polyester or nylon, the slits should be cut using a heated blade, since the heat causes the sheet material to melt, thus sealing the cut edges to provide reinforcement and prevent unraveling or fraying.

Figure 6:
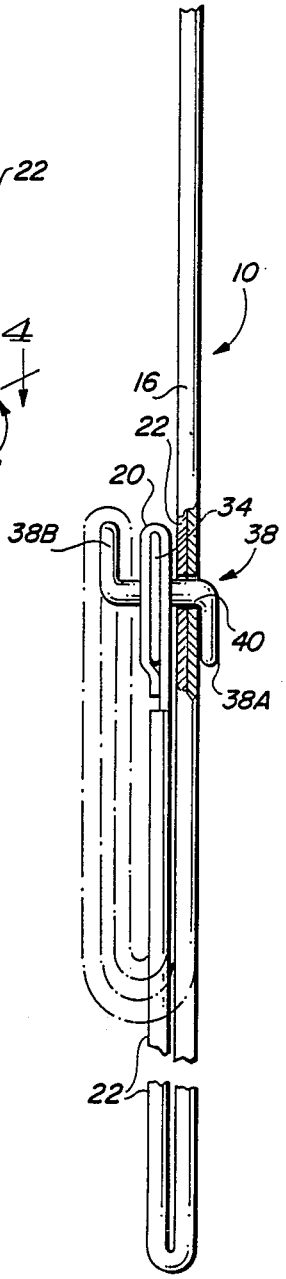
FIG. 6 is an enlarged fragmentary side view, partially broken away, showing the window shade of the present invention in a folded position.
Figure 4:
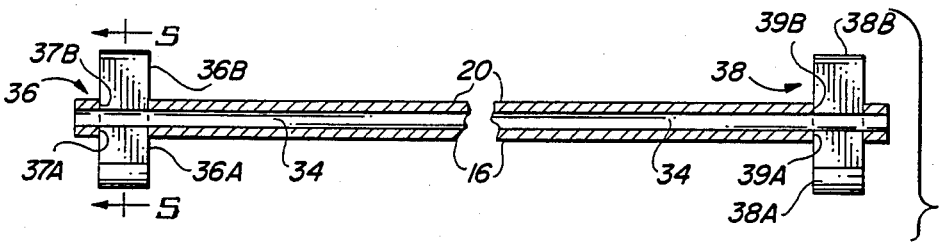
FIG. 4 is an enlarged fragmentary sectional view taken through line 4—4 of FIG. 1.

In order to raise the shade 10 from a position covering the entire window 12 to a position allowing light to shine through a bottom portion of the window, it is simply necessary to fold the bottom edge of the shade 10 upwardly as shown in FIG. 6. When the shade is folded in this manner, the upwardly turned portions 36A and 38A of hook means 36, 38 respectively, are passed through a selected transversely aligned pair of slits 40 to hold the shade 10 in the folded position. If each hook means 36, 38 consists only of a single forwardly extending upwardly turned hook, then the shade 10 may simply be folded forwardly and upwardly once, and secured in the singularly folded position on the room facing side of the shade by inserting the hook means 36, 38 in a selected pair of the slits 40 provided in the side edges of the shade, as indicated by the solid lines in FIG. 6. Similarly, if each hook means 36, 38 consists of a single rearwardly extending upardly turned hook, then the shade 10 may be simply folded rearwardly and upwardly once and secured in a singularly folded position on the window facing side of the shade 10. However, if each hook means 36, 28 consists of a double hook, then it is possible to fold the shade twice, for instance by first foling it forwardly and upwardly (i.e. away from the window 12) and inserting the front portions 36A, 38A, each of which is now in a downturned position of hook means 36, 38 through a first pair of slits 40, and then folding it forwardly again and inserting the now upturned portions 36B, 38B of the hook means 36, 38 through a second pair of slits 40, as indicated by the phantom lines in FIG. 6. This doubly folded configuration allows a greater portion of the window 12 to be exposed than does the single folded configuration, thus allowing a greater amount of light to enter the room.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

I claim as my invention:

1. A temporary shade for covering a window in a wall of a building, said shade comprising:

(a) a sheet of relatively rugged, disposable material, said sheet including:

i. a front face for facing the interior of said building, ii. a rear face for facing the window, iii. a top edge folded rearwardly and secured to said rear face to form a top hem, iv. a bottom edge folded rearwardly and secured to said rear face to form a bottom hem, and v. a pair of spaced apart, parallel side edges, each folded rearwardly and secured to said rear face to form a side hem;

(b) a top stiffener strip in said top hem to rigidify the top edge of said sheet for securing thereof to the wall adjacent the window;

(c) a bottom stiffener strip in said bottom hem for weighting the bottom edge of said sheet and ensuring that said sheet hangs properly;

(d) demountable fastener means for demountably securing said sheet to the wall adjacent the window; and (e) elements of a demountable interconnection on said bottom stiffener strip and intermediate portions of said sheet for selectively and temporarily securing said bottom edge of said sheet to said intermediate portions of said sheet in a folded configuration to vary the effective length of said sheet said demountable interconnection including:

i. a pair of hook means secured to said bottom stiffener strip, each of said hook means being secured proximate a different opposite end of said bottom stiffener strip, each of said hook means comprising a double hook including an upturned portion projecting from one face of said sheet and a downturned portion projecting from the opposite face of said sheet to allow said sheet to be folded twice; and ii. a plurality of pairs of transversely aligned slits, each slit of each pair of slits being formed through a different one of the side hems of said shade proximate a side edge thereof, each of said pairs corresponding to a different effective length of said sheet.

2. A temporary apparatus for covering a window and for selectively exposing a portion of the window, said apparatus comprising in combination:

(a) a shade;

(b) means for securing said shade in a depending relationship from a location proximate the upper part of the window;

(c) means for accommodating selective folding of a section of said shade back upon itself to reduce the extent to which said shade covers the window;

(d) means for retaining the folded back section of said shade in place; and (e) said retaining means including means for detachably attaching the folded section of said shade to the remaining part of said shade, when in the folded back position said attaching means comprising a hook and a corresponding aperture in said shade, said hook attaching the folded back section of said shade to the remaining part of said shade by engaging said aperture;

whereby, a portion of the window corresponding to the folded section of said shade is exposed.

3. The apparatus as set forth in claim 2 wherein said retaining means includes means for receiving said hook.

4. A temporary apparatus for covering a window and for selectively exposing a portion of the window, said apparatus comprising in combination:

(a) a shade;

(b) means for securing said shade in a depending relationship from a location proximate the upper part of the window;

(c) means for accommodating selective folding of a section of said shade back upon itself to reduce the extent to which said shade covers the window;

(d) means for retaining the folded back section of said shade in place; and (e) said retaining means including means for detachably attaching the folded section of said shade to the remaining part of said shade, when in the folded back position said shade including two opposed lateral edges and wherein said attaching means comprises a hook at least one aperture associated with each lateral edge, said hook attaching the folded back section of said shade to the remaining part of said shade by engaging a corresponding aperture;

whereby a portion of the window corresponding to the folded section of said shade is exposed.

5. The apparatus as set forth in claim 4 wherein said retaining means includes means associated with each lateral edge for receiving the respective one of said hooks.

6. A temporary apparatus for covering a window and for selectively exposing a portion of the window, said apparatus comprising in combination:

(a) a shade (b) means for securing said shade in a depending relationship from a location proximate the upper part of the window;

(c) means for accommodating selective folding of a section of said shade back upon itself to reduce the extent to which said shade covers the window, said accommodating means including means for folding back more than once the folded back section of said shade to further reduce the extent to which shade covers the window;

(d) means for retaining the folded back section of said shade in place; and (e) said retaining means including means for detachably attaching the folded section of said shade to the remaining part of said shade;

whereby, a portion of the window corresponding to the folded section of said shade when in the folded back position is exposed.

7. The apparatus as set forth in claim 6 wherein said attaching means comprises a hook for attaching all of the folded back sections of said shade to the remaining part of said shade.

8. The apparatus as set forth in claim 7 wherein said retaining means includes means for receiving said hook.

9. The apparatus as set forth in claim 7 wherein said shade includes lateral edges and wherein said attaching means comprises a hook associated with each lateral edge and wherein said retaining means includes disposed along the lateral edges for receiving the respective one of said hooks.

* * * * *